US008182288B1

(12) United States Patent
Lin

(10) Patent No.: US 8,182,288 B1
(45) Date of Patent: May 22, 2012

(54) PROBE CONNECTOR

(75) Inventor: Jui-Pin Lin, New Taipei (TW)

(73) Assignee: Chen Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/030,148

(22) Filed: Feb. 18, 2011

(51) Int. Cl.
*H01R 13/648* (2006.01)

(52) U.S. Cl. ..... 439/607.01

(58) Field of Classification Search ..... 439/607.01, 439/700, 824, 219, 482, 857
See application file for complete search history.

(56) References Cited

U.S. PATENT DOCUMENTS 2,774,052 A * 12/1956 Flour ..... 361/744
7,662,000 B2 * 2/2010 Hou et al. ..... 439/824
7,815,474 B1 * 10/2010 Lin et al. ..... 439/700
7,909,660 B2 * 3/2011 Tsunoda et al. ..... 439/700
2004/0115994 A1 * 6/2004 Wulff et al. ..... 439/700
* cited by examiner

*Primary Examiner* — Jean F Duverne
(74) *Attorney, Agent, or Firm* — Lin & Associates IP, Inc.

(57) ABSTRACT

A probe connector includes an insulating housing of which a top protrudes upward to form a plurality of inserting pillars each defining an inserting hole vertically penetrating therethrough, and a bottom defines a plurality of fixing holes each vertically extending to be connected with a bottom of one inserting hole. A plurality of probe pins is inserted upward in the inserting holes through the corresponding fixing holes respectively. A shielding body made of metal defines a plurality of inserting openings arranged in accordance with the inserting pillars and each vertically penetrating through the shielding body. The inserting pillars each are inserted in one of the inserting openings with a top end of the probe pin stretching in the corresponding inserting opening, so that each of the probe pins is enclosed by the shielding body to make the probe pins separated from one another by the shielding body.

4 Claims, 4 Drawing Sheets

PROBE CONNECTOR

BACKGROUND OF THE INVENTION

1. Field of the Invention

The present invention relates to a probe connector, and more particularly to a probe connector capable of shielding electromagnetic interference effectively.

2. The Related Art

A traditional probe connector generally includes an insulating housing and a plurality of probe pins. The insulating housing has a base body and a tongue portion protruded upward from a middle of a top of the base body. The insulating housing defines a plurality of inserting holes vertically penetrating through the base body and the tongue portion. The probe pins are inserted in the inserting holes of the insulating housing respectively. However, the probe connector described above has no shielding structure. As a result, an electromagnetic interference is apt to happen among the probe pins.

SUMMARY OF THE INVENTION

An object of the present invention is to provide a probe connector. The probe connector includes an insulating housing having a base body of which a top surface protrudes upward to form a plurality of inserting pillars spaced from one another. Each of the inserting pillars defines an inserting hole extending vertically to penetrate through a top thereof. A bottom of the base body defines a plurality of fixing holes each aligned with one of the inserting holes and extending vertically to be connected with a bottom of the corresponding inserting hole. A plurality of probe pins is inserted upward in the inserting holes of the insulating housing through the corresponding fixing holes respectively, with a top end of the probe pin further projecting out of the inserting hole. A shielding body made of metal defines a plurality of inserting openings each extending vertically to penetrate through the shielding body. The inserting openings are arranged in accordance with the inserting pillars of the insulating housing and each has a substantial same diameter as the one of the inserting pillar. The inserting pillars each are inserted in one of the inserting openings of the shielding body with the top end of the probe pin stretching in the corresponding inserting opening, so that each of the probe pins is enclosed by the shielding body to make the probe pins separated from one another by the shielding body.

As described above, the probe pin is inserted in the inserting hole of the insulating housing through the corresponding fixing hole, and then the inserting pillars each are inserted in one of the inserting openings of the shielding body. So that each of the probe pins can be enclosed by the shielding body to make the probe pins separated from one another by the shielding body. So the probe connector of the present invention can achieve a better effect of shielding electromagnetic interference among the probe pins, and electrical signals can be transmitted effectively in the probe connector.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
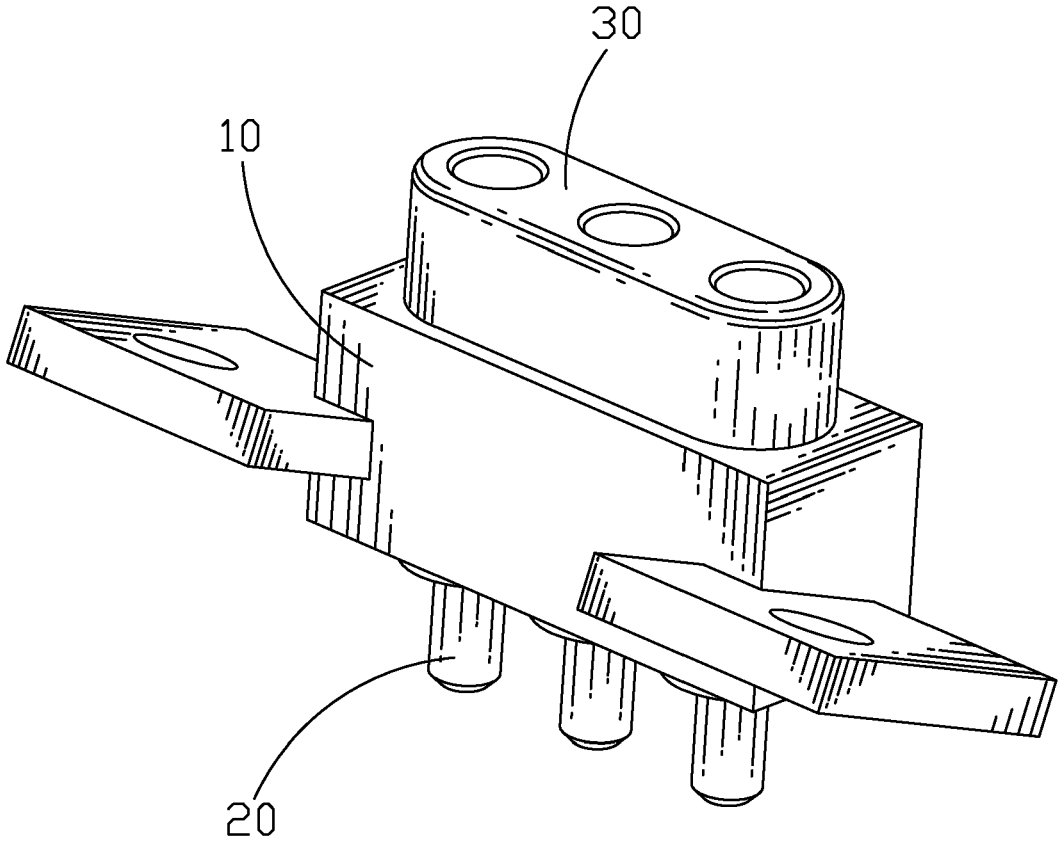
FIG. 1 is an assembled perspective view of a probe connector according to the present invention.

With reference to FIG. 1, a probe connector according to the present invention includes an insulating housing 10, a plurality of probe pins 20 and a shielding body 30 mounted to the insulating housing 10 respectively.

Figure 2:
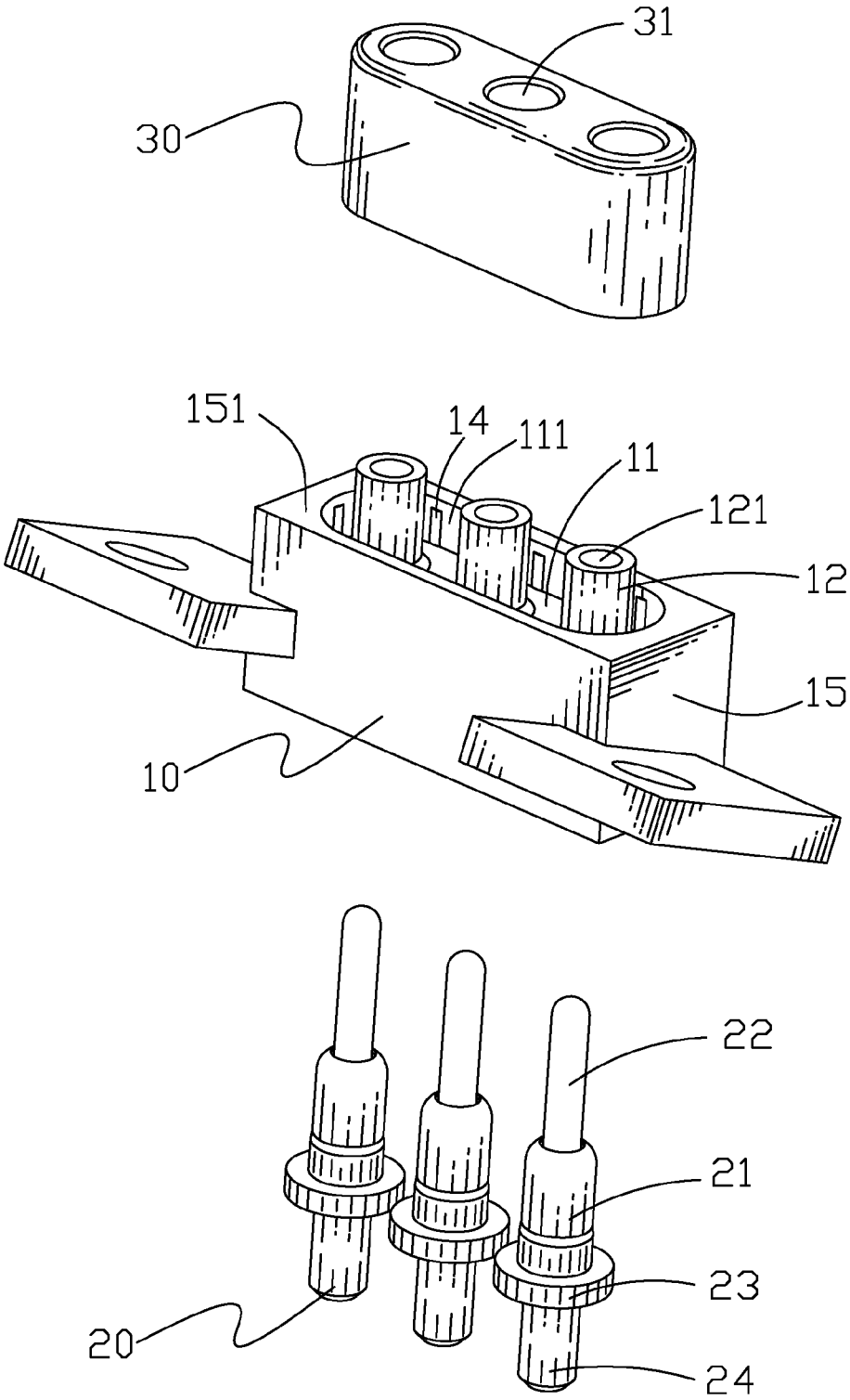
FIG. 2 is an exploded perspective view of the probe connector of FIG. 1.
Figure 3:
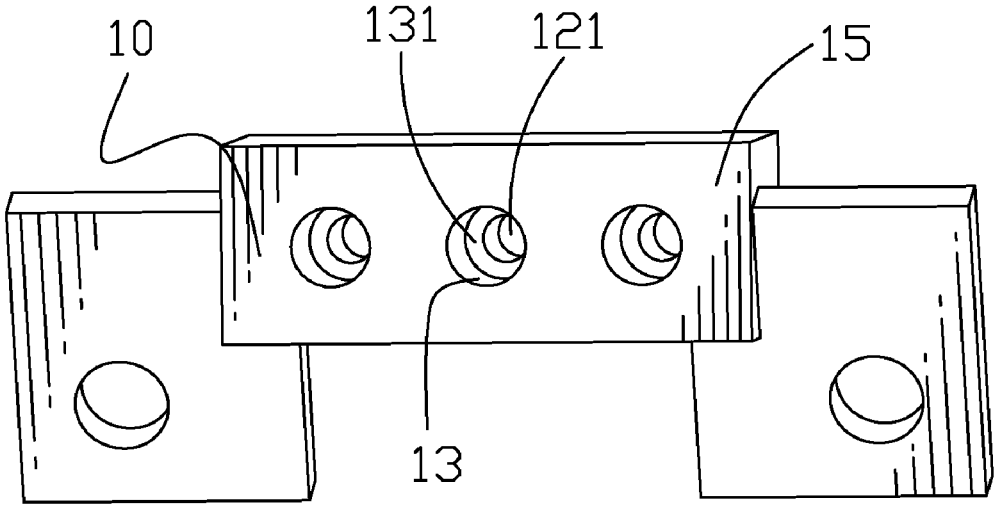
FIG. 3 is a perspective view of an insulating housing of the probe connector of FIG. 2.

Referring to FIGS. 2-3, the insulating housing 10 has a base body 15 of rectangular shape. The base body 15 has a top surface 151 thereof concaved downward to form a receiving cavity 11 of elliptic shape seen from a top view. A bottom side of the receiving cavity 11 protrudes upward beyond the top surface 151 to form a plurality of columned inserting pillars 12 spaced from one another and apart from an inside periphery face 111 of the receiving cavity 11. Each of the inserting pillars 12 defines an inserting hole 121 extending vertically to penetrate through a top of the inserting pillar 12. A bottom of the base body 15 defines a plurality of fixing holes 13 each aligned with one of the inserting holes 121 and extending vertically to be connected with a bottom of the corresponding inserting hole 121. The fixing hole 13 has a greater diameter than that of the inserting hole 121, and accordingly, a ring-shaped blocking slope 131 is formed at the connection of the fixing hole 13 and the corresponding inserting hole 121. The inside periphery face 111 of the receiving cavity 11 is provided with a plurality of resisting ribs 14 each extending vertically.

Referring to FIG. 2, the probe pin 20 has a barrel 21. A plunger 22 is movably inserted in the barrel 21 and further projects out of a top end of the barrel 21. A periphery outside of a bottom end of the barrel 21 protrudes outward to form a ring-shaped blocking portion 23. A bottom side of the barrel 21 extends downward to form a soldering portion 24.

Figure 4:
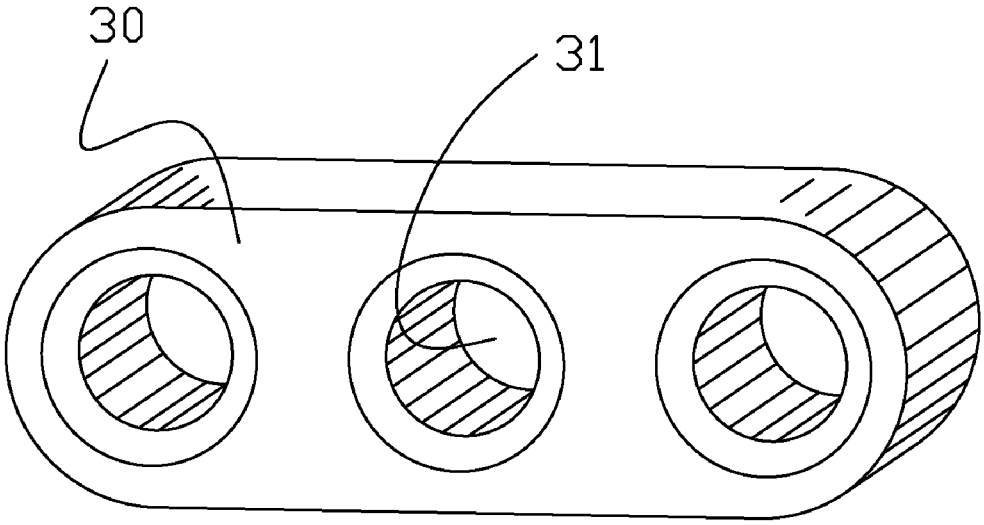
FIG. 4 is a perspective view of a shielding body of the probe connector of FIG. 2.
Figure 5:
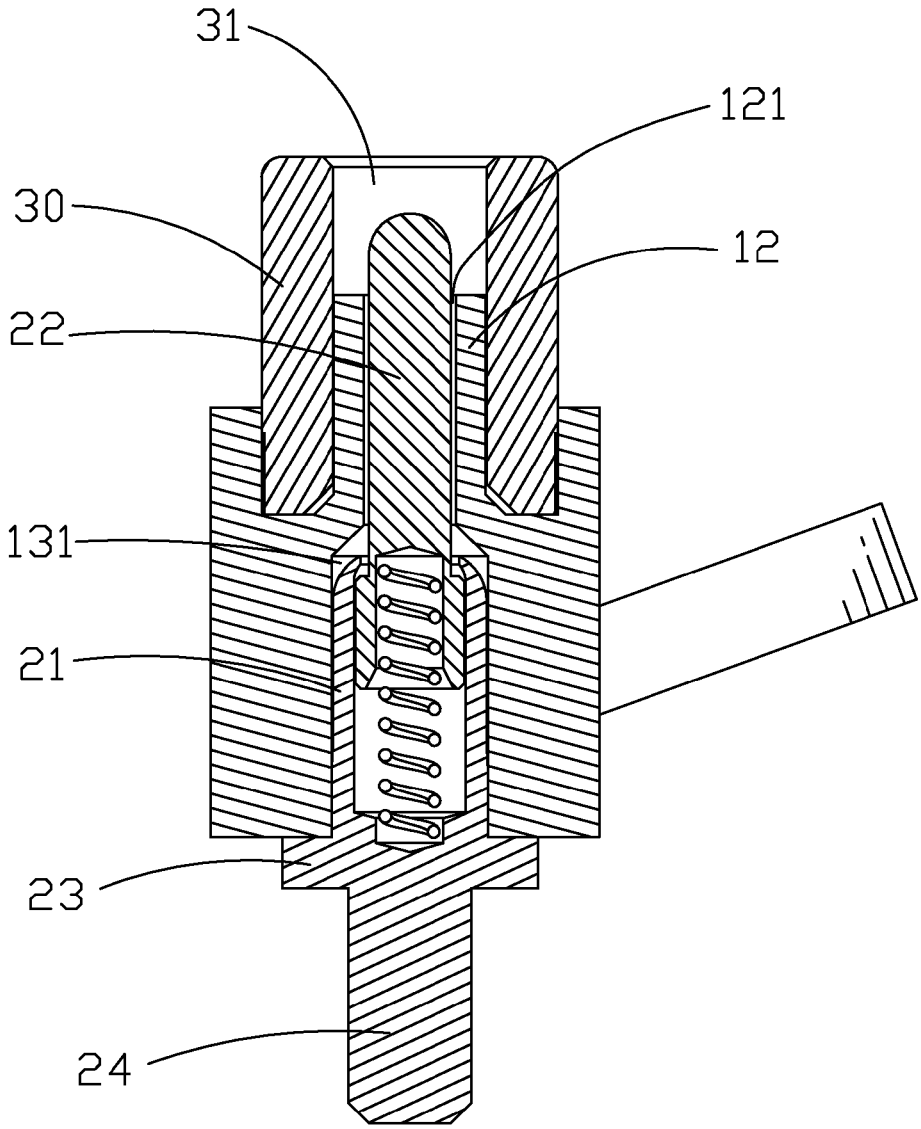
FIG. 5 is a cross-sectional view of the probe connector of FIG. 1.

Referring to FIG. 2 and FIG. 4, the shielding body 30 is made of metal and shows an elliptical shape seen from a top view. The shielding body 30 defines a plurality of columned inserting openings 31 each extending vertically to penetrate through the shielding body 30 and arranged in accordance with the inserting pillars 12 of the insulating housing 10. Each of the inserting openings 31 has a substantially same diameter as the one of the inserting pillar 12.

Referring to FIGS. 1-5, in assembly, the probe pins 20 are inserted upward into the fixing holes 13 of the insulating housing 10 respectively to make the plungers 22 inserted in the inserting holes 121, until a periphery of the top end of the barrel 21 resists against the blocking slope 131. At this time, a top end of the plunger 22 further projects out of the inserting hole 121, and the barrel 21 is fastened in the fixing hole 13. The blocking portion 23 abuts against the bottom of the base body 15, and the soldering portion 24 projects under the base body 15. The shielding body 30 is assembled in the receiving cavity 11, with a periphery outside of a bottom end thereof abutting against the inside periphery face 111 of the receiving cavity 11, and the inserting pillars 12 inserted in the inserting openings 31 of the shielding body 30 respectively with the top end of the plunger 22 stretching in the inserting opening 31. The resisting ribs 14 abut against the periphery outside of the bottom end of the shielding body 30 to secure the shielding body 30 with the inserting pillars 12.

As described above, the plunger 22 of the probe pin 20 is inserted in the inserting hole 121 of the insulating housing 10, and then the inserting pillars 12 each are inserted in one of the inserting openings 31 of the shielding body 30. So that each of the probe pins 20 can be enclosed by the shielding body 30 to make the probe pins 20 separated from one another by the shielding body 30. So the probe connector of the present invention can achieve a better effect of shielding electromagnetic interference among the probe pins 20, and electrical signals can be transmitted effectively in the probe connector.

What is claimed is:

1. A probe connector, comprising:

an insulating housing having a base body of which a top surface protrudes upward to form a plurality of inserting pillars spaced from one another, each of the inserting pillars defining an inserting hole extending vertically to penetrate through a top thereof, a bottom of the base body defining a plurality of fixing holes each aligned with one of the inserting holes and extending vertically to be connected with a bottom of the corresponding inserting hole;

a plurality of probe pins inserted upward in the inserting holes of the insulating housing through the corresponding fixing holes respectively, with a top end of the probe pin further projecting out of the inserting hole; and a shielding body made of metal and defining a plurality of inserting openings each extending vertically to penetrate through the shielding body, the inserting openings being arranged in accordance with the inserting pillars of the insulating housing and each having a substantially same diameter as the diameter of the inserting pillar, the inserting pillars each being inserted in one of the inserting openings of the shielding body with the top end of the probe pin stretching in the corresponding inserting opening so that each of the probe pins is enclosed by the shielding body to make the probe pins separated from one another by the shielding body wherein the probe pin includes a barrel and a plunger movably inserted in the barrel and further projecting out of a top end of the barrel, the barrel is fastened in the fixing hole, and the plunger is inserted in the inserting hole with a top end thereof projecting out of the inserting hole, a bottom side of the barrel extends downward to form a soldering portion projecting under the base body, the fixing hole of the insulating housing has a greater diameter than the diameter of the inserting hole, a ring-shaped blocking slope is formed at the connection of the fixing hole and the corresponding inserting hole, and a periphery of the top end of the barrel resists against the blocking slope.

2. The probe connector as claimed in claim 1, wherein the top surface of the base body is concaved downward to form a receiving cavity, a bottom side of the receiving cavity protrudes upward beyond the top surface to form the inserting pillars spaced from an inside periphery face of the receiving cavity, the shielding body has a bottom end thereof inserted in the receiving cavity, with a periphery outside of the bottom end thereof abutting against the inside periphery face of the receiving cavity.

3. The probe connector as claimed in claim 2, wherein the inside periphery face of the receiving cavity is provided with a plurality of resisting ribs each extending vertically, the resisting ribs abut against the periphery outside of the bottom end of the shielding body to secure the shielding body with the inserting pillars.

4. The probe connector as claimed in claim 1, wherein a periphery outside of a bottom end of the barrel protrudes outward to form a blocking portion abutting against the bottom of the base body.

* * * * *